US005498102A

United States Patent [19]

Bissell

[11] Patent Number: 5,498,102

[45] Date of Patent: Mar. 12, 1996

[54] ELECTROMECHANICAL TIRE DEFLATING SPIKE STRIP

[76] Inventor: Sheldon Bissell, P.O. Box 135, Mt. Ranch, Calif. 95246

[21] Appl. No.: 391,593

[22] Filed: Feb. 21, 1995

[51] Int. Cl.[6] ..... E01F 13/00

[52] U.S. Cl. ..... 404/6; 404/9; 256/1

[58] Field of Search ..... 404/6, 9; 256/1, 256/13.1; 116/1, 4, 7, 352, 202

[56] References Cited

U.S. PATENT DOCUMENTS

| | | | |
|---|---|---|---|
| 4,318,079 | 3/1982 | Dickinson | 340/127 |
| 4,965,571 | 10/1990 | Jones | 340/932.2 |
| 4,995,756 | 2/1991 | Kilgrow | 404/6 |
| 5,253,950 | 10/1993 | Kilgrow | 404/6 |
| 5,330,285 | 7/1994 | Greves et al. | 404/6 |

FOREIGN PATENT DOCUMENTS 9305236 3/1993 United Kingdom .

*Primary Examiner*—Ramon S. Britts
*Assistant Examiner*—Pamela A. O'Connor
*Attorney, Agent, or Firm*—Basil Travis

[57] ABSTRACT

A tire puncturing spike strip is disclosed which can be placed on a road surface in front of a moving vehicle. The spike strip is comprised of essentially rectangular modular frame units with low height for easy storage in a trunk of a police vehicle, and the frame units have interlocking ends which can be quickly assembled in any desired length for placement across a roadway with spikes in a normal down position to allow safe passage of vehicles over the strip, but said spikes may be selectively and remotely activated to their up position electromechanically by an operator to target a specific fleeing vehicle. Once the fleeing vehicle crosses over the strip, the spikes may be electromechanically returned to their down position to allow pursuing police cars to safely cross over the strip and apprehend the disabled fleeing vehicle.

11 Claims, 3 Drawing Sheets

ELECTROMECHANICAL TIRE DEFLATING SPIKE STRIP

BACKGROUND OF THE INVENTION

1. Field of the Invention

The present invention pertains to law enforcement equipment, and more particularly to non-lethal devices employed by police agencies on a roadway during pursuit to safely and almost instantly stop a fleeing vehicle.

More specifically, the present invention relates to deployable modular frame units of hollow spikes which may be quickly and easily snapped together to form any desired length of a continuous strip across a roadway, wherein said spikes are maintained in a normal down position to allow passage of vehicles until such time as said spikes are remotely activated electromechanically into an up position to selectively stop a fleeing vehicle by puncturing its tires.

Once the fleeing vehicle crosses over the strip, the spikes may be electromechanically returned to their down position to allow pursuing police cars to safely cross over the strip and apprehend the disabled fleeing vehicle.

2. Discussion of the Prior Art

As it is perhaps well known, there have recently been several notorious chases of fleeing vehicles whose drivers refuse to stop or try to outrun the police. Some of the most famous chases involved armed and dangerous criminals who had virtually nothing to lose by using their vehicle to crash through classic police roadblocks which often resulted in bodily injury and great property damage.

As it may also be perhaps well known, the classic police roadblock by which police cars are parked across a roadway results in blockage of all vehicular traffic and thereby often causes congestion of citizen drivers at the roadblock who must either be allowed to pass by movement of police cars or risk physical harm in any subsequent confrontation between the police and driver of a fleeing vehicle.

In other words, classic police roadblocks are non-selective, cause congestion and often result in more injury than they are worth.

Accordingly, the prior art reveals attempts to replace classic police roadblocks with a selective and safe means for stopping a fleeing vehicle by puncturing its tires. A preferred device in use today is known as a spike strip and there are several variations, but none have the advantages of the present invention.

One of the earlier known spike strips simply consisted of a narrow length of flat rubber or fabric base containing a multitude of nails oriented in the same direction so that the strip could be coiled for storage in a trunk of a police car, but upon approach of a fleeing vehicle the coil could be rolled across a roadway in the path of the vehicle whereby the nails would puncture the tires.

However, in practice it soon became apparent that a coil of nails had several inherent problems.

First, the nails often snagged upon each other as the coil was unwound and often ensnaring itself or other items.

Secondly, someone had to physically place the outstretched strip with nails upright in the path of an oncoming vehicle which was usually driven a very high speed thereby allowing a few seconds to complete the task.

Thirdly, this type of coiled spike strip was non-selective in that any innocent vehicle ahead of a fleeing vehicle on the same roadway would obviously contact the nails and thereby most often result in the entire strip being adhered to the tires and dislodged from the roadway.

And, forth, even when initial contact was made between the strip and fleeing vehicle, it was often seen that solid nails alone did not deflate tires rapidly enough and the vehicle would continue for several more miles before being disabled.

Although some variations of improved coiled spike strips are found in current use in many countries today, their flexible coils have been generally replaced by rigid foundational base sections hinged together and capable of being folded for storage, such as the "Portable Road Blocker" manufactured by MITI Company of Grand Junction, Colo. Moreover their solid nails of bygone years have presently been replaced by hollow spikes, some of which also contain a longitudinal slit for the purpose of rapidly deflating a tire upon impact.

But in any event, all of the known spike strips in current use have many of the same problems previously discussed because of their non-selectivity and requirement for timely deployment and removal upon a roadway.

Accordingly, it is one general object of the present invention to provide a spike strip of interlocking modular frame units which can be easily and rapidly snapped together in a variety of lengths for placement across the surface of a roadway.

It is another object of the present invention to provide a spike strip of slitted hollow spikes in a down position within said modular frame units which but when assembled may be remotely activated electromechanically to their up positions to target and puncture the tires of a specific fleeing vehicle.

It is yet one further object of the present invention to provide a spike strip of modular frame units having a virtually low vertical silhouette or height for both purposes of concealment and more importantly to allow safe passage of vehicles over it.

It is still another further object of the present invention to provide a spike strip which may be electronically and remotely activated by merely plugging its circuitry into the cigarette lighter connection of a police car where it may be activated by an operator by simply activating or deactivating a switch.

It is still yet one further object of the present invention to provide a spike strip with a red signal light thereon to apprise an operator when the spikes are in an upright position.

These objects, among others, are achieved in the present invention.

SUMMARY OF THE INVENTION

Accordingly, the present invention provides a portable spike strip having a solid structural support of relatively flat modular sectional rectangular frame units with length greater than width, and which may be quickly and easily snapped together by hand to extend across and upon a surface of a roadway in any desired length.

Connection of said modular frame units is accomplished by way of a lock and key type pattern at their distal ends which compliment each other for interlocking as many units as necessary to form a single length of the strip across a road.

One end of the assembled strip is also connected to an end plate with similar lock and key pattern wherein said end plate provides electronic circuitry necessary for pivitol activation of a plurality of hollow-slitted spikes by raising them from their normal flat position on the frame to an up position relatively vertical to the longitudinal plane of said frame. A red light preferably mounted on the end plate is automatically turned on when the spikes are raised, and the light is automatically turned off when the spikes are lowered.

Both raising and lowering of the spikes may be accomplished remotely by an operator positioned safely within his vehicle by merely plugging a standard electrical cord from the end plate into the vehicle's cigarette lighter outlet. Of course, a variety of known remote switching devices may be added to the circuitry as well as a separate 12 volt battery in absence of close proximity to a vehicle's power supply.

A plurality of hollow-slitted spikes arranged in a single row parallel to the longitudinal plane of the frame are removably fixed into a rotatable cylindrical shaft so that when the raised spikes contact and penetrate a pneumatic tire the spikes are pulled from the shaft and remain in the tire for its rapid deflation. The cylindrical shaft is rotatably positioned within a longitudinal trough along a top length of each frame unit thereby resulting in the frame's cross-sectional scalene triangular configuration, but having a very low apex or profile with flat base for placing on a roadway surface.

Each end of a cylindrical shaft within a modular frame unit has a tapered male or female fitting with a spring biased locking ring so that as the modular frame units are snapped together the cylindrical shafts are also easily connected by hand.

The frame modular unit, being made of high-impact plastic, also comprises two different elevational slopes on its upper surface bisected by the cylindrical shaft and corresponding to its cross-sectional scalene triangular configuration. The wider top portion having a lesser slope provides for gradual elevation in height for a rolling pneumatic tire to allow vehicles to safely pass over the frame when the spikes are in a down position. This wider side of the frame also contains planar slots perpendicular to the cylindrical shaft for receiving and maintaining the spikes below the surface of the frame when the spikes are in a down position so that the modular frame units may be handled safely.

Thus, it is believed that one major advantage of the present invention over known spike strips is that the spike strip of the present invention provides remote and selective operation to target any particular fleeing vehicle, while providing safe passage over the strip for other vehicles. These and other advantages will become apparent in the following drawings, detailed description and claims.

DESCRIPTION OF THE PREFERRED EMBODIMENT

Before turning to the drawings, it might be briefly observed here that in bygone years it was not uncommon for the police to simply shoot out the tires of a fleeing vehicle and disable it, but today police agencies are very conscious about civil liability arising from high speed chases and, in fact, there are several policies which require abandoning such pursuit if endangering the public. Indeed, police today often rely on mobile radio communications to alert other police units ahead to attempt to disable a fleeing vehicle by use of a spike strip, such as the present invention illustrated in FIG. 1.

Figure 1:
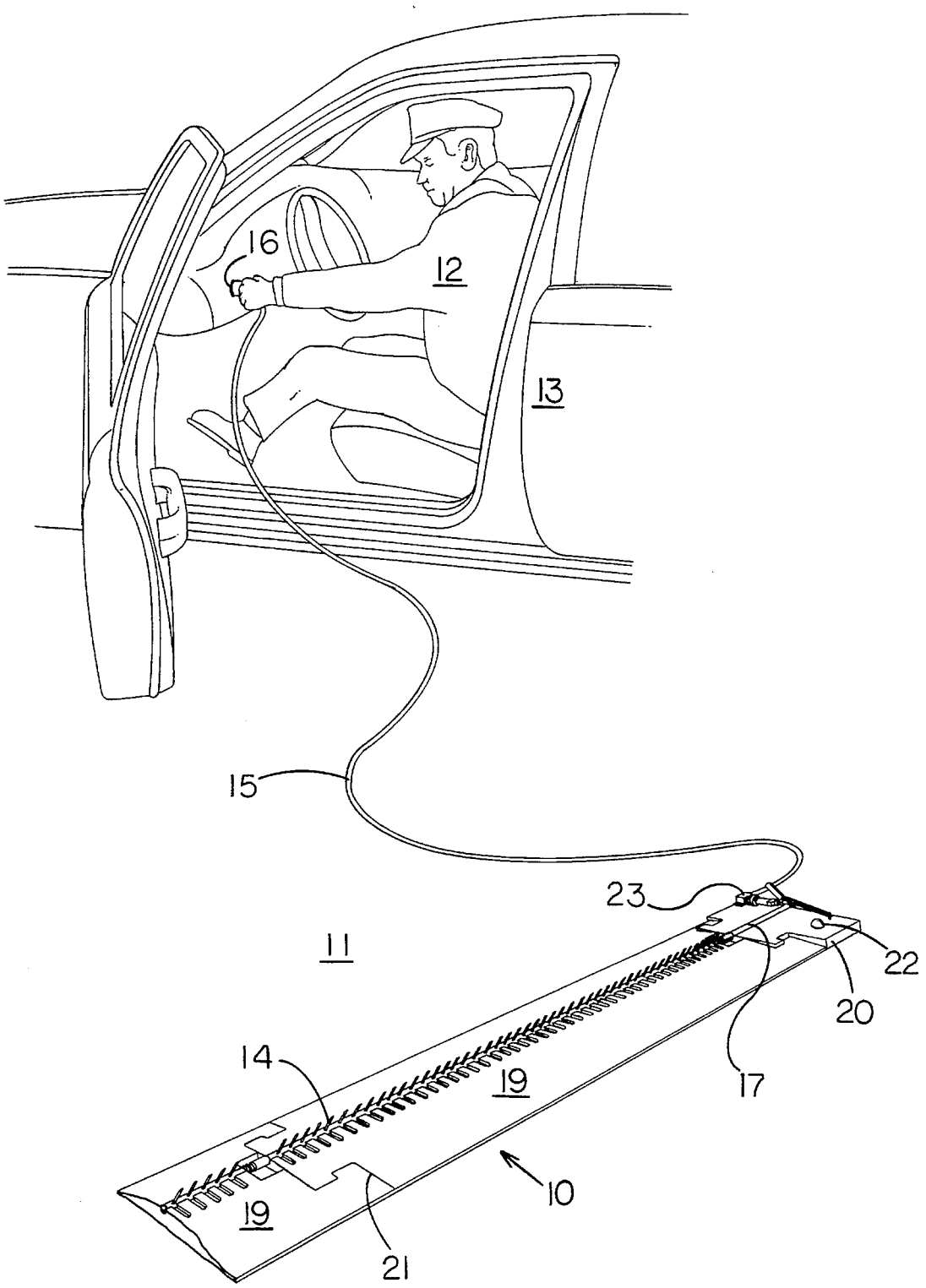
FIG. 1 is a perspective illustration of the present invention in use on a roadway surface and operated remotely from a police car.

In FIG. 1, the spike strip 10 of the present invention is illustrated assembled across a surface of a roadway 11. Also depicted is a police officer 12 safely positioned in his police car 13 while activating a plurality of hollow-slitted spikes 14 to their up position by merely plugging an electric cord 15 into a cigarette lighter outlet 16. Activation of the spikes to an up position may be accomplished by several different electromechanical means known in the art, but in this preferred embodiment a 12-volt selonoid 23 is utilized for rotation of a cylindrical shaft 17 which will be explained in greater detail in FIG. 5. A red signal light 22 with circuitry connected with that of the selonoid 23 is automatically turned on when said spikes 14 are in an up position and automatically turned off when the spikes are in a down position.

It may also be seen in FIG. 1 that the raised spikes 14 are not exactly vertical in their up position, but are oriented slightly forward so as to meet and penetrate an oncoming pneumatic vehicle tire. Since the spikes 14 are closely placed together in a single line, it is evident, although not illustrated, that both front tires of a vehicle crossing the strip 10 will be impaled by numerous spikes 14, said spikes also being dislodged from their cylindrical shafts 17 and remaining in the tires for rapid but controlled deflation.

Although several different spike designs are known and may be utilized in the strip 10, one configuration comprising a hollow spike having a longitudinal slit along one side is preferred because it has been found that this particular configuration more rapidly deflates a pneumatic tire than does plain hollow spikes or solid nails, yet does not cause a blowout nor loss of control of the vehicle. Moreover, said spikes 14 are removably but snugly contained in resilient sockets 18 along the shaft 17 so that they may be replaced by simply inserting new ones in any empty socket once the strip 10 is used.

In FIG. 1 it may be further noted that strip 10 comprises several modular frame units 19 interlocked together and terminating at an end plate 20. These modular frame units 19, being relatively flat and rectangular planar configuration with length greater than width, are illustrated connected together by a lock and key pattern 21 at their distal ends by which the said units 19 may be quickly and easily snapped together as shown in FIG. 2.

Figure 2:
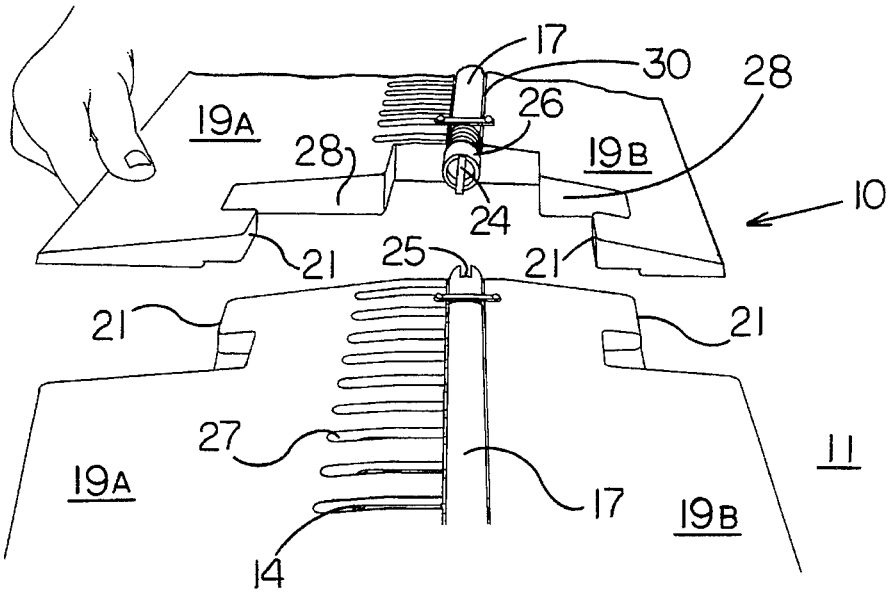
FIG. 2 is a partial perspective view showing how the modular frame units are interlocked together by hand.

FIG. 2 illustrates one preferred method of assembling the modular frame units 19 by simply and quickly snapping their interlocking end patterns 21 together by hand to produce a strip 10 of any desired length across the surface of a roadway 11. This feature is believed another advantage over other known spike strips which have limited extended lengths.

For example, if a modular frame unit 19 is four feet in length, then four units 19 could be easily carried in the trunk of a police car to provide sixteen feet of spike strip 10 which is believed sufficient to extend across most roadways.

Figure 3:
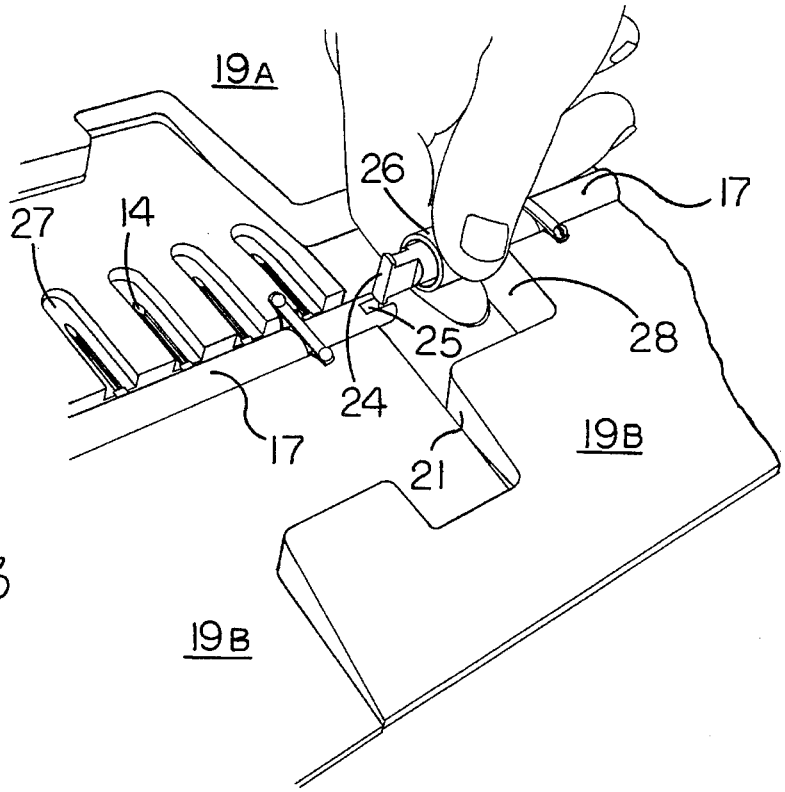
FIG. 3 is a perspective view illustrating connection of ends of the cylindrical shafts between each modular frame unit shown in FIG. 2.

FIG. 3 shows connection of each cylindrical shaft 17 between modular frame units 19 by means of a tapered male fitting 24 being inserted into a tapered female fitting 25 which is accomplished by pulling back a spring biased locking ring 26 and simply pushing said fittings 24 and 25 together as the frame units 19 are also connected.

It should also be noted in FIGS. 2 and 3 that the spikes 14 are in their normal down position and maintained within planar slots 27 below the top surface of each modular frame unit 19 for safe handling. Also FIGS. 2 and 3 provide perspective views of a scalene triangular cross-sectional shape 28 of the modular frame unit 19 resulting in two different elevational slopes 19*a* and 19*b* on its top surface, the wider part 19*a* having a lesser slope for receiving a rolling pneumatic tire and allowing it to safely pass over said frame 19 when the spikes 14 are in a down position. Thus, one further advantage of the present invention over other known spike strips is that the spike strip of the present invention is nearly flat and will allow vehicles to safely pass over it at high speed.

Figure 4:
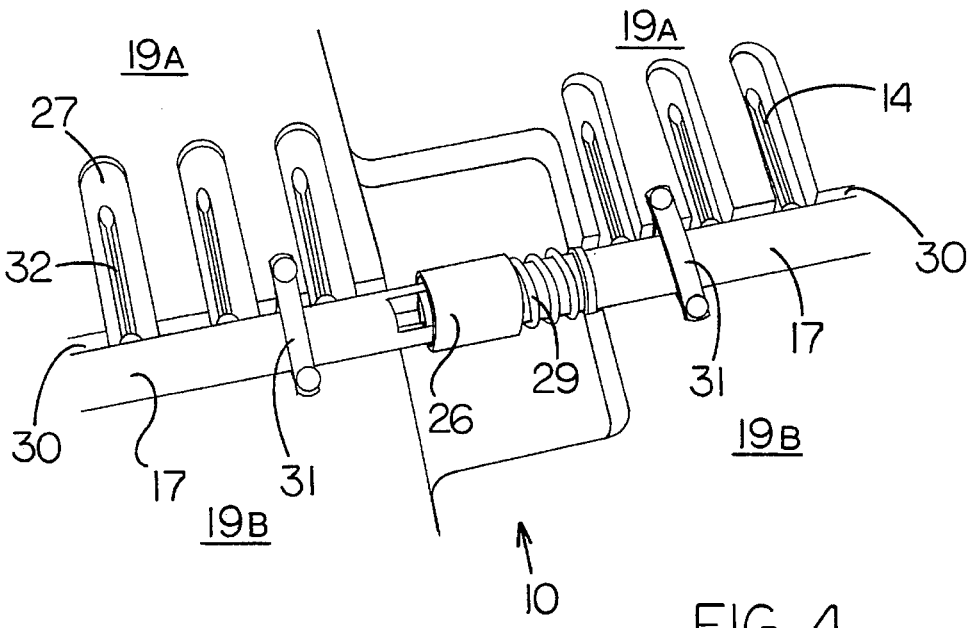
FIG. 4 is another view of FIG. 3 but showing a spring-biased locking ring in place to lock the shaft ends together.

Referring now to FIG. 4, another view of FIG. 3, it may be seen that when locking ring 26 is released it is biased forward by spring 29 to encircle fittings 24 and 25 of FIG. 3 and thereby completing interconnection of two modular frame units 19. Also shown more clearly in FIG. 4 is trough 30 which merely consists of a longitudinal channel located along and within a longitudinal apex or top of each modular frame unit 19 for seating therein a circular shaft 17 held is said trough 30 by straps 31. This arrangement provides an essentially level top or apex in each unit 19 between two different elevational slopes 19*a* and 19*b* so that when spikes 14 are in a down position as shown within their slots 27, the spike strip 10 will allow safe and smooth passage of an innocent vehicle over it. In FIG. 4 there is also more clearly illustrated the particular shape of the spikes 14, with their slits 32 for rapid deflation of a pneumatic vehicle tire, said slitted hollow spikes 14 believed being yet a further advantage over other known spike strips currently in use.

Figure 5:
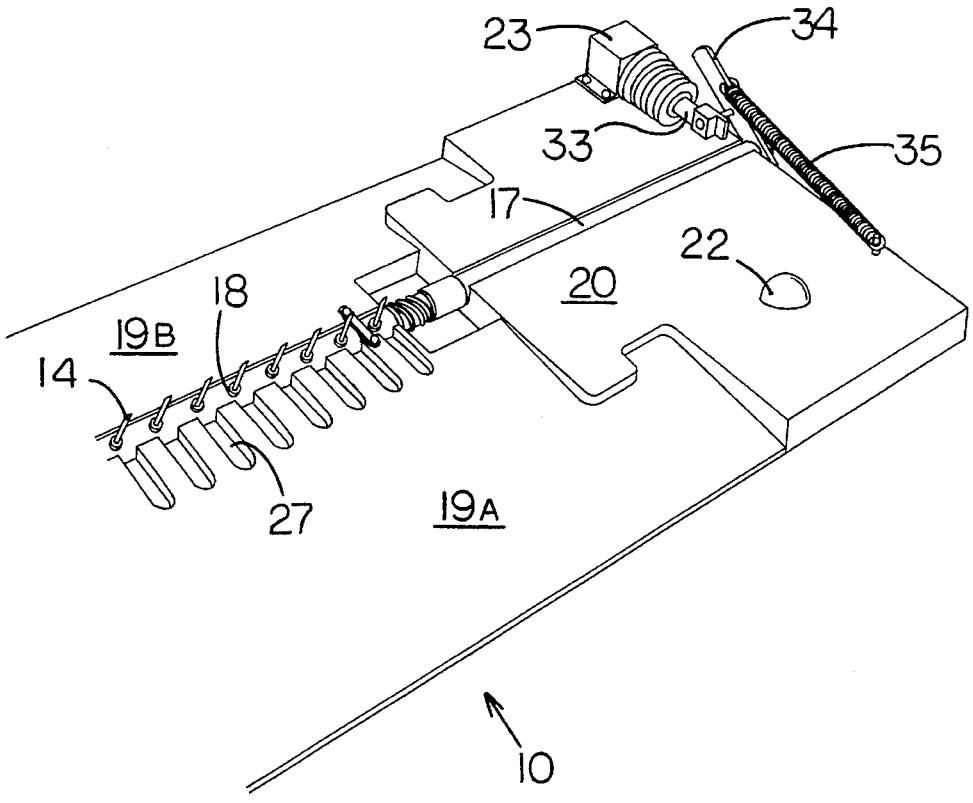
FIG. 5 is a top plan view of an end plate with electromechanical circuitry illustrated thereon for activation of the spike strip.

In FIG. 5, an enlarged view of one end of the spike strip shown in FIG. 1, the spikes 14 are in their up position made possible by electromechanical activating means on an end plate 20. In this enlarged view it may be more clearly seen that the spikes 14 are releasably held in preferably resilient sockets 18 for easy replacement when dislodged by a tire rolling over them.

Also, and as previously mentioned, there are several known ways to turn a shaft by various electromechanical means so that it should be understood that the spirit and scope of the present invention is not limited to those electromechanical means illustrated in FIG. 5, as that they are merely illustrative of one preferred method.

Mounted on end plate 20 of FIG. 5 is a solenoid 23 with solenoid arm 33 attached to a lever 34 by a linkage. The lever 34 is also connected to an end of shaft 17 so that when the solenoid 23 is energized said solenoid arm 33 will pull the lever 34 toward it and thereby turn the shaft 17. A biasing spring connects the lever 34 with a position on the end plate 20 opposite the solenoid 23 so that when the solenoid is energized the spring 35 is stretched as shown in FIG. 5 as the shaft 17 is turned, but when the solenoid 23 is not energized the spring 35 will bias said lever away from the solenoid 23 thereby turning said shaft 17 and its spikes 14 to their normal down position.

There is one final advantage of the electromechanical activating arrangement illustrated in FIG. 5 and that is in any absence of electricity, the spike strip 10 may be manually operated by merely moving the lever 34 by hand.

Having described my invention in detail, I claim

1. A vehicle tire deflating spike strip for deployment and use upon a road surface, comprising:

(a) essentially rectangular solid modular frame units of low height but length greater than width and ends having means for rapid interlocking of the units together by hand to form and extend the spike strip to various desired lengths across a roadway;

(b) a plurality of hollow spikes with slits along their sides;

(c) means for releaseably retaining the spikes in the strip;

(d) means for raising and lowering the spikes;

(e) means for protecting a user while handling the spike strip;

(f) means for alerting a user when the spikes are raised in an up position wherein the means for alerting a user is an illuminated red light when a solenoid, which is used for raising the spikes, is energized.

2. The tire deflating spike strip of claim 1, wherein said means for interlocking the frame units together are interlocking end patterns.

3. The tire deflating spike strip of claim 1, wherein said frame units have scalene cross-sectional triangular configuration.

4. The tire deflating spike strip of claim 1, wherein said frame units contain a rotatable circular shaft therein.

5. The tire deflating spike strip of claim 1, wherein said hollow-slitted spikes are removably retained upon a rotatable circular shaft.

6. The tire deflating spike strip of claim 1, wherein said means for releaseably retaining spikes are resilient sockets in a rotatable circular shaft.

7. The tire deflating spike strip of claim 1, wherein the means for raising and lowering the spikes is by rotation of a circular shaft.

8. The tire deflating spike strip of claim 1, wherein the means for raising the spikes is by energizing a solenoid.

9. The tire deflating spike strip of claim 1, wherein the means for lowering the spikes is by deenergizing a solenoid.

10. The tire deflating spike strip of claim 1, wherein the means for raising and lowering the spikes is by movement of a lever by hand.

11. The tire deflating spike strip of claim 1, wherein the means for protecting the user comprises a plurality of slots for receiving spikes in their normal down position.

* * * * *